US007758112B2

(12) United States Patent
Huang

(10) Patent No.: US 7,758,112 B2
(45) Date of Patent: Jul. 20, 2010

(54) FOLDABLE CHAIR CAPABLE OF BEING OVERLAPPED WITH OTHER CHAIRS VERTICALLY

(76) Inventor: Tsung-Chieh Huang, 235 Chung-Ho, Box 8-24, Taipei (TW)

( * ) Notice: Subject to any disclaimer, the term of this patent is extended or adjusted under 35 U.S.C. 154(b) by 0 days.

(21) Appl. No.: 12/243,956

(22) Filed: Oct. 1, 2008

(65) Prior Publication Data

US 2010/0078971 A1 Apr. 1, 2010

(51) Int. Cl.
*A47C 4/04* (2006.01)
*A47C 4/08* (2006.01)
*A47C 3/04* (2006.01)

(52) U.S. Cl. ..... 297/23; 297/239

(58) Field of Classification Search ..... 297/23, 297/239

See application file for complete search history.

(56) References Cited

U.S. PATENT DOCUMENTS 128,767 A * 7/1872 Viele ..... 297/18
274,730 A * 3/1883 Decker ..... 297/57
779,327 A * 1/1905 Stiggleman ..... 248/164
941,135 A * 11/1909 Moulin ..... 472/50
945,032 A * 1/1910 Gillespie ..... 472/50
976,786 A * 11/1910 Moulin ..... 472/50
1,176,915 A * 3/1916 Loveless ..... 248/432
1,423,594 A * 7/1922 Barrows ..... 297/56
1,424,031 A * 7/1922 Peters ..... 297/56
1,568,244 A * 1/1926 Rosenkranz ..... 297/56
1,591,550 A * 7/1926 Rosenthal ..... 248/188.9
1,608,911 A * 11/1926 Smith ..... 248/432
1,721,164 A * 7/1929 Newell et al. ..... 297/56
1,740,806 A * 12/1929 Clarin ..... 297/56
1,760,008 A * 5/1930 Schermerhorn ..... 297/56
1,873,768 A * 8/1932 Kux ..... 297/56
1,900,486 A * 3/1933 Clarin ..... 297/56
1,949,492 A * 3/1934 Schermerhorn ..... 297/57
1,975,622 A * 10/1934 Schermerhorn ..... 297/452.55
2,016,385 A * 10/1935 Molling et al. ..... 297/57
2,182,761 A * 12/1939 Johnson ..... 297/56
2,247,236 A * 6/1941 Johannsen ..... 297/19
2,649,141 A * 8/1953 Marshall et al. ..... 108/120
2,982,339 A * 5/1961 Clarin ..... 297/56
3,220,764 A * 11/1965 Duer ..... 297/56
3,695,687 A * 10/1972 Uyeda ..... 297/56
5,096,259 A * 3/1992 Stanfield ..... 297/239
5,328,232 A * 7/1994 Whitehead ..... 297/58
5,681,078 A * 10/1997 Chen ..... 297/58
5,738,408 A * 4/1998 Wu ..... 297/239
6,092,866 A * 7/2000 Wu ..... 297/56

(Continued)

*Primary Examiner*—Rodney B White

(57) ABSTRACT

A foldable chair capable of being overlapped with other chairs vertically comprises two front legs, two rear legs and a seat plate. An inner side of each front leg has a recess for assembling the rear leg and a T shape buckle; each of two sides of a top end of an outer side of each rear leg has a post for assembling the seat plate; and each of two outer ends of a rear side of the seat plate has a C shape tenon which can be assembled to the T shape buckle at the inner side of the front leg; and each of two ends of an inner side of the seat plate has a sliding groove for assembling the post of the rear leg. The chair can be assembled without screws, but it still has a firm structure and the assembly work can be positioned quickly and easily.

2 Claims, 7 Drawing Sheets

U.S. PATENT DOCUMENTS 6,099,073 A * 8/2000 Bruschi ..... 297/59
6,234,571 B1 * 5/2001 Atkins et al. ..... 297/16.1
6,279,991 B1 * 8/2001 Atkins et al. ..... 297/16.1
6,305,742 B1 * 10/2001 Spendlove et al. ..... 297/16.1
6,345,863 B1 * 2/2002 Laws et al. ..... 297/56
6,382,716 B1 * 5/2002 Wu ..... 297/56
6,422,645 B1 * 7/2002 Smith et al. ..... 297/56
6,478,375 B2 * 11/2002 Richardson ..... 297/248
6,592,182 B1 * 7/2003 Noor ..... 297/239
6,612,654 B2 * 9/2003 Laws et al. ..... 297/440.11
6,655,731 B2 * 12/2003 Martin ..... 297/23
6,669,281 B1 * 12/2003 Huang ..... 297/58
6,682,138 B2 * 1/2004 Adams et al. ..... 297/56
6,709,050 B2 * 3/2004 Huang ..... 297/57
6,742,839 B2 * 6/2004 Piretti ..... 297/239
6,863,341 B1 * 3/2005 Wen ..... 297/23
6,890,026 B1 * 5/2005 Shin ..... 297/16.1
6,905,168 B2 * 6/2005 Noor ..... 297/239
6,953,221 B1 * 10/2005 Tseng et al. ..... 297/23
6,969,113 B2 * 11/2005 Krawchuk ..... 297/23
7,080,877 B1 * 7/2006 Tsai ..... 297/23
7,111,902 B1 * 9/2006 Conner ..... 297/248
7,131,225 B2 * 11/2006 Wu ..... 40/320
7,226,123 B1 * 6/2007 Lin et al. ..... 297/56
7,331,628 B2 * 2/2008 Lin ..... 297/16.2
7,350,324 B2 * 4/2008 Wu ..... 40/320
7,410,211 B1 * 8/2008 Lin et al. ..... 297/23

* cited by examiner

FOLDABLE CHAIR CAPABLE OF BEING OVERLAPPED WITH OTHER CHAIRS VERTICALLY

FIELD OF THE INVENTION

The present invention relates to foldable chairs, in particular to a foldable chair capable of being overlapped with other chairs vertically, which is assembled screwlessly, while provides a steady structure.

BACKGROUND OF THE INVENTION

The prior art foldable chairs are made of metals or by using composite material. The welding, riveting or screwing is used in the manufacturing process. Time and labor are wasted in the manufacturing process. The processes of bending and embedding are needed. Thus the cost is high.

Furthermore, in the prior art foldable chair, it is unsuitable for overlapping the chairs for storage and transformation. Furthermore, it is difficult to position the overlapping chairs.

SUMMARY OF THE INVENTION

Accordingly, the object of the present invention is to provide a foldable chair capable of being overlapped with other chairs vertically, wherein in assembly of the chair, no screw is used.

To achieve above object, the present invention provides a foldable chair capable of being overlapped with other chairs vertically, comprising two front legs, two rear legs and a seat plate, wherein an inner side of each front leg has a recess for assembling the rear leg and a T shape buckle; each of two sides of a top end of an outer side of each rear leg has a post for assembling the seat plate; each of two outer ends of a rear side of the seat plate has a C shape tenon which can be assembled to the T shape buckle at the inner side of the front leg; each of two ends of an inner side of the seat plate has a sliding groove for assembling the post of the rear leg.

Therefore, the chair of the present invention can be assembled without screws, but it still has a firm structure and the assembly work can be performed quickly and easily with less time and higher efficiency. Moreover, the chairs can be overlapped vertically with less space so as to be transferred effectively and with lower transfer costs.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
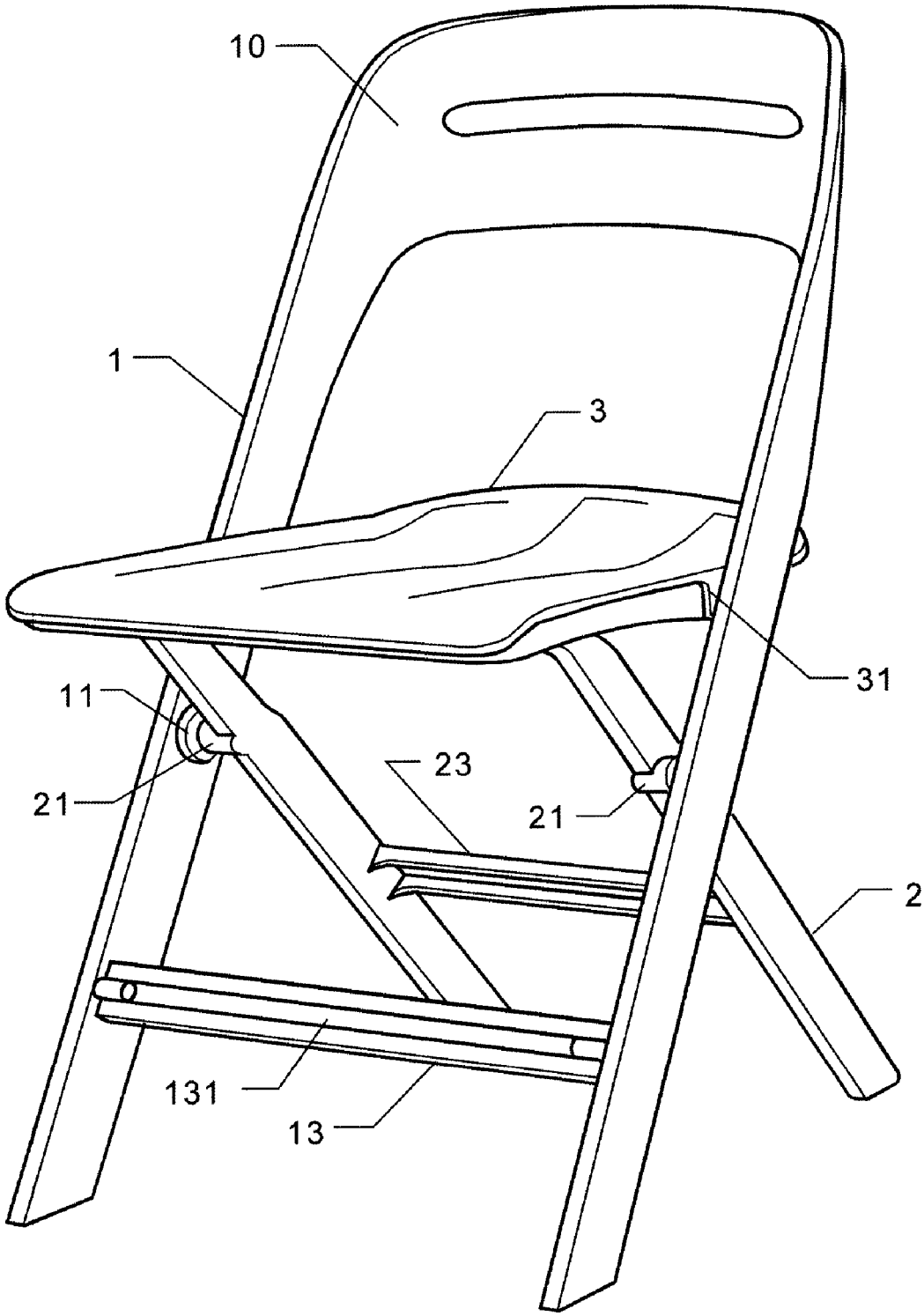
FIG. 1 is a perspective view of the present invention.
Figure 2:
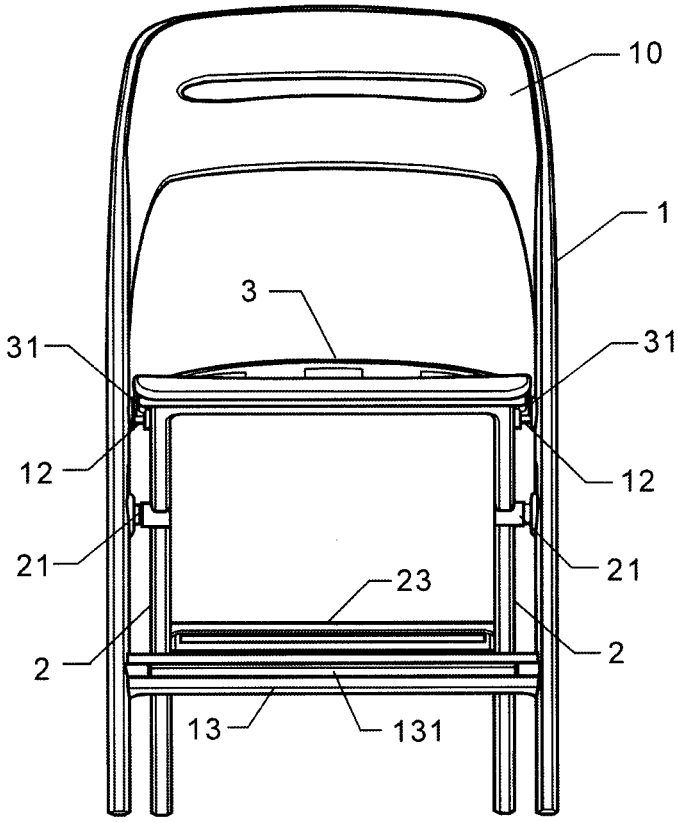
FIG. 2 is a front view of the present invention.
Figure 3:
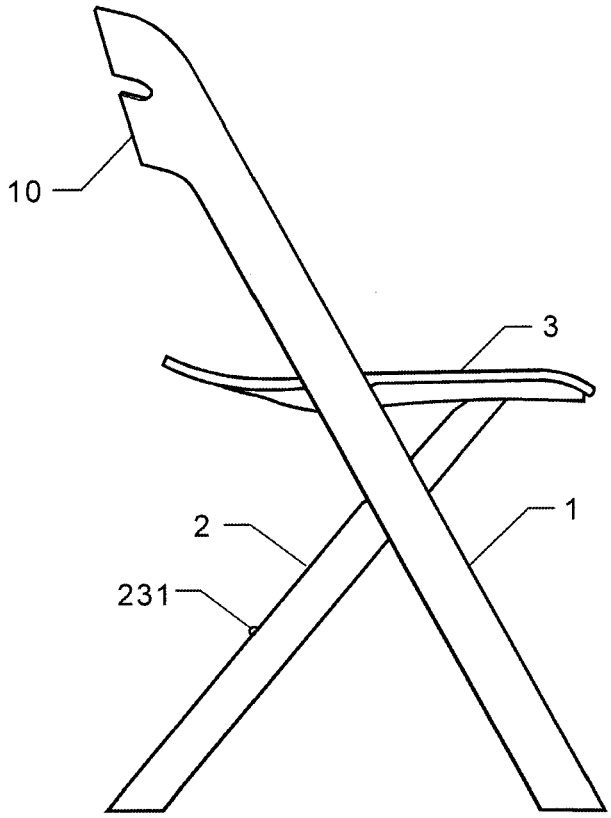
FIG. 3 is a left side view of FIG. 2.
Figure 4:
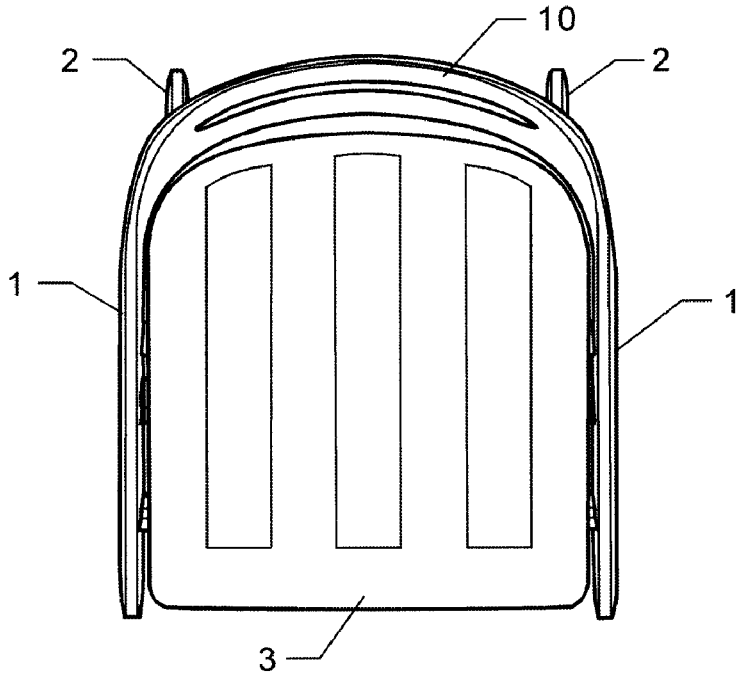
FIG. 4 is an elevational view of FIG. 2.
Figure 5:
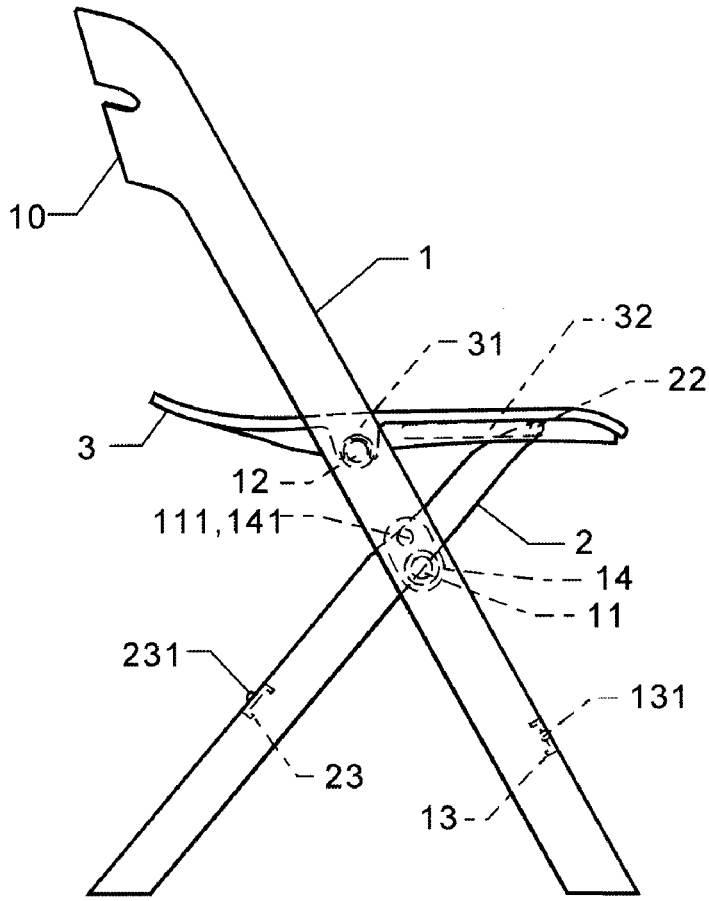
FIG. 5 is a schematic view showing the combination of the present invention.
Figure 6:
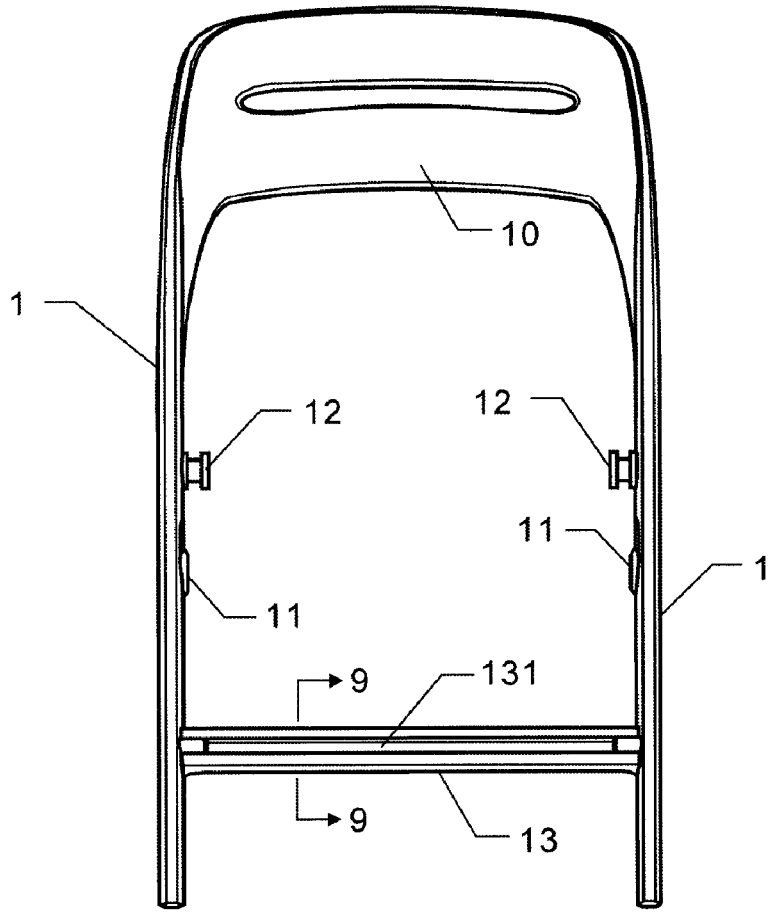
FIG. 6 shows the front leg of the present invention.
Figure 7:
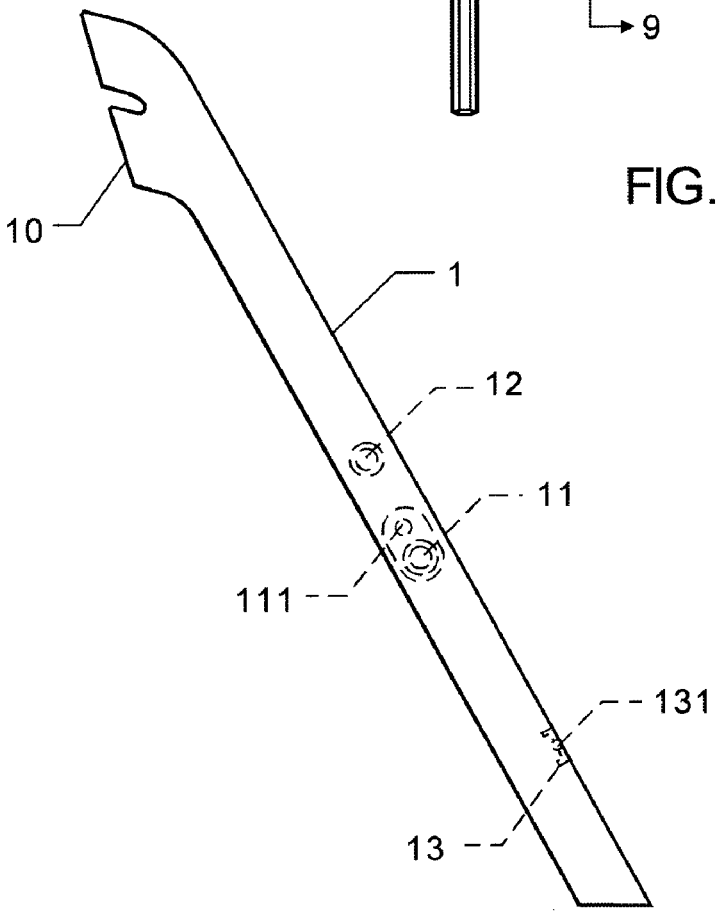
FIG. 7 is a left side view of FIG. 6.
Figure 9:
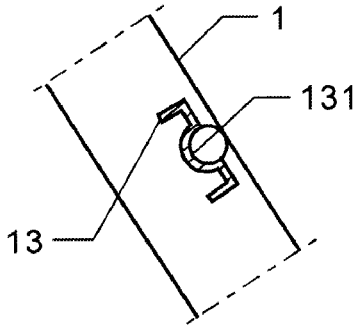
FIG. 9 is a cross sectional view along line 9-9 of FIG. 6.
Figure 8:
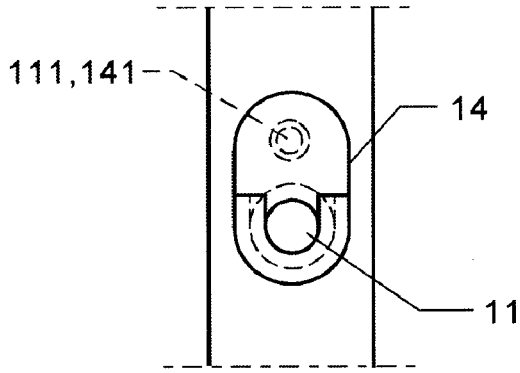
FIG. 8 is a schematic view showing the combination of the hole of the front leg and the cover.
Figure 10:
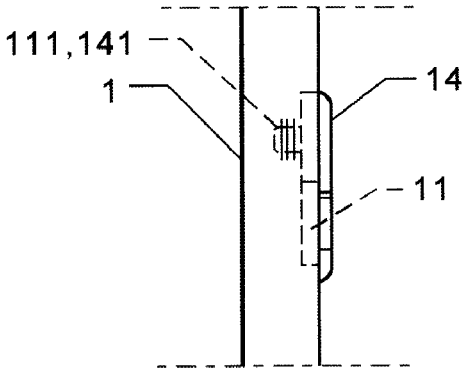
FIG. 10 is a left side view of FIG. 8.

Referring to FIG. 1, the combination of the chair of the present invention has no screw, while it can provide a steady structure as a plurality of chairs are overlapped vertically. The chair has the following elements. The chair is made of polypropylene (PP) plastics mixing with fibers and is formed by air injection.

Figure 11:
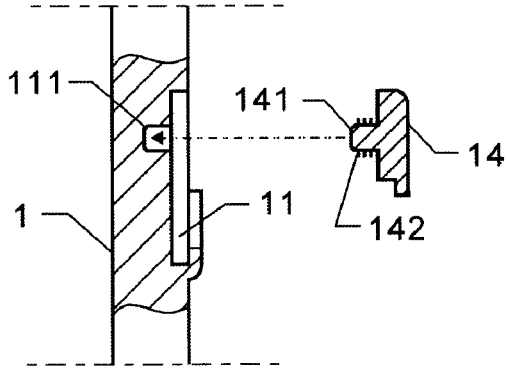
FIG. 11 is a schematic view showing the assembly of the cover in FIG. 10.
Figure 12:
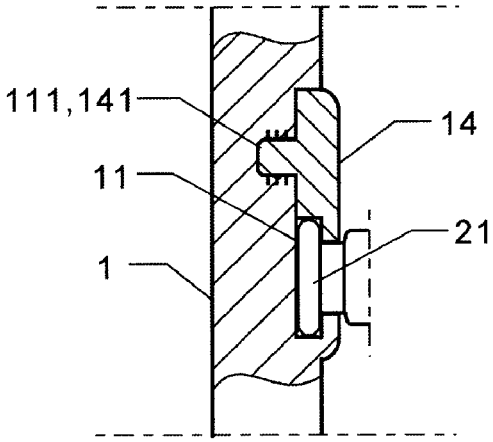
FIG. 12 is a schematic view showing the combination of the hole, cover and T shape buckle.

Referring to FIGS. 6 to 12, two front legs are included. An inner side of each front leg has a recess 11 for assembling the rear leg 2 and a T shape buckle 12. A transversal rod 13 serves to connect the two front legs 1. The transversal rod 13 has a trench 131. A hole 111 is formed in the recess 11 for retaining a cover 14 (as shown in FIGS. 11 and 12).

Figure 14:
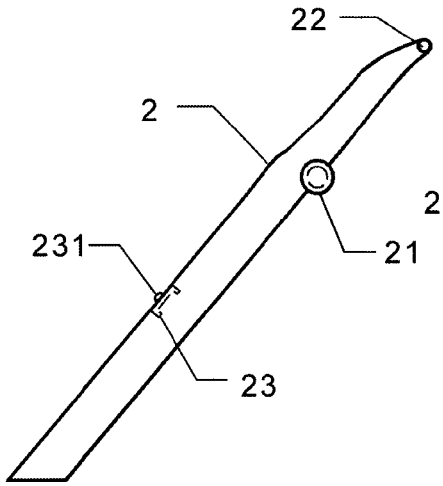
FIG. 14 is a left side view of FIG. 13.
Figure 13:
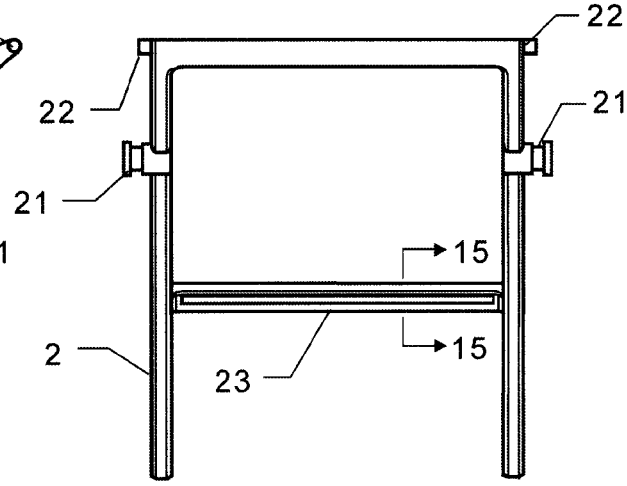
FIG. 13 shows the rear leg of the present invention.
Figure 15:
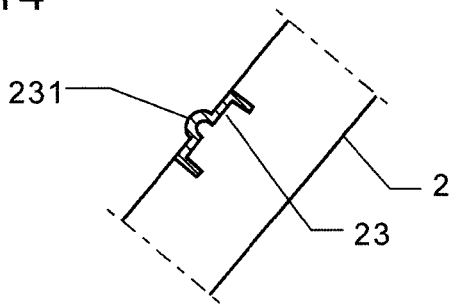
FIG. 15 is a cross sectional view along line 15-15 of FIG. 16.
Figure 17:
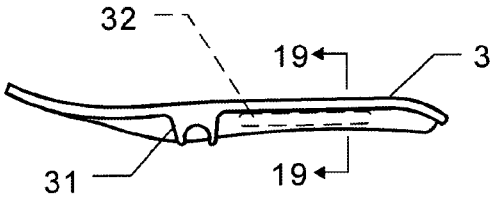
FIG. 17 is a left side view of FIG. 16.
Figure 16:
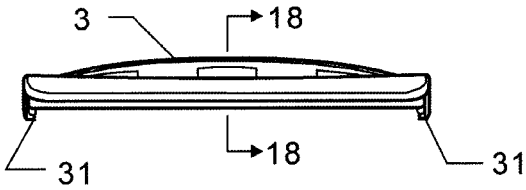
FIG. 16 shows the seat plate of the present invention.
Figure 18:
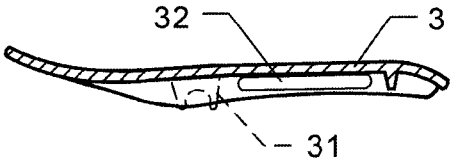
FIG. 18 is a cross sectional view along line 18-18 of FIG. 17.
Figure 19:
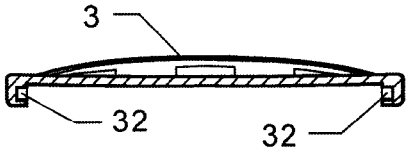
FIG. 19 is a cross sectional view along line 19-19 of FIG. 17.
Figure 20:
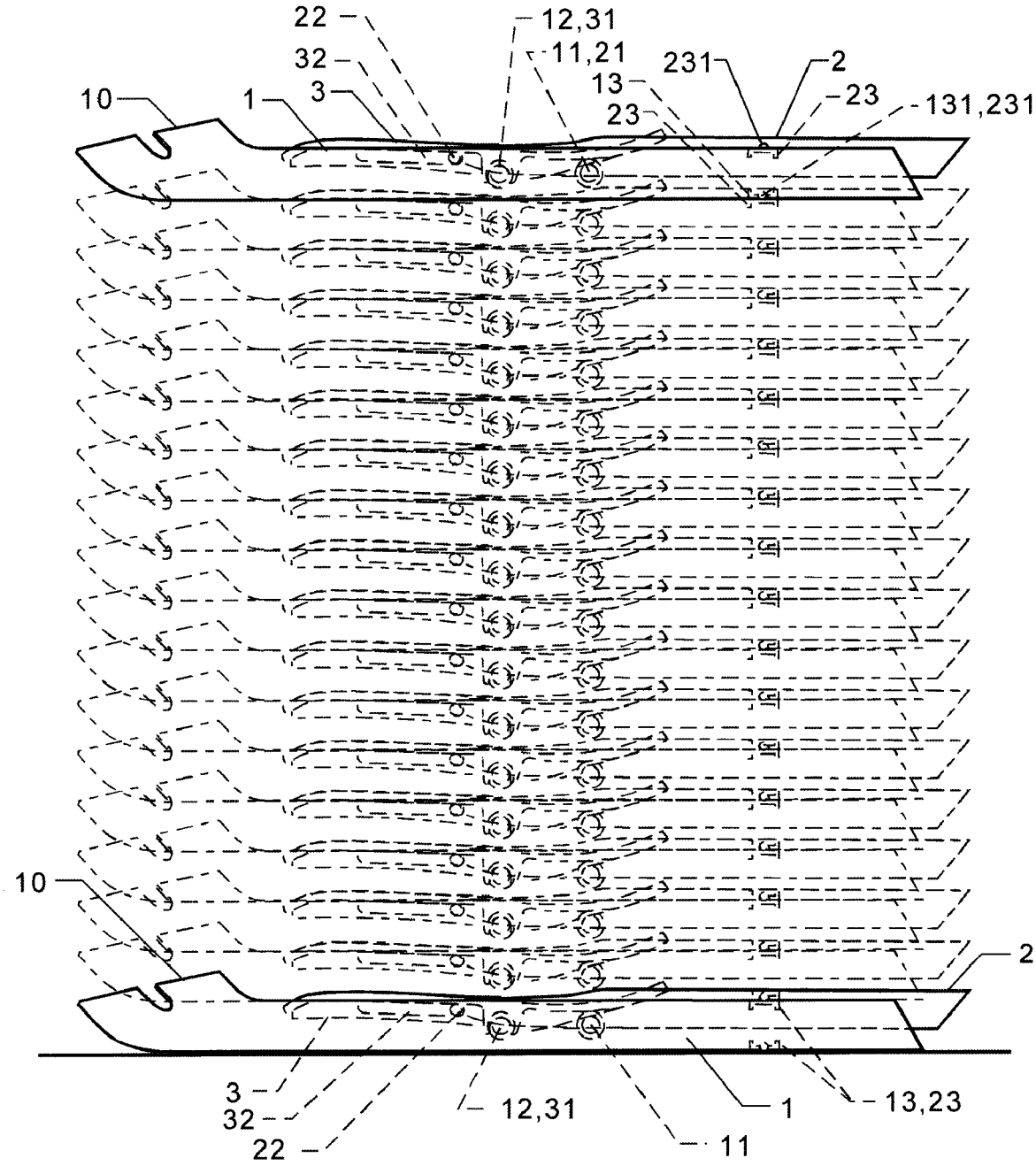
FIG. 20 is schematic view showing the overlapping of the chairs of the present invention.

Referring to FIGS. 13 to 15, two rear legs 2 are included. Each of two sides of a top end of an outer side of each rear leg 2 has a post 22 for assembling a seat plate 3. A transversal bar 23 is assembled between two inner sides of the two rear legs 2. Each of two ends of the transversal bar 23 has a strip 231 which can be embedded into the trench 131 of the transversal rod 13.

Referring to FIGS. 16 to 19, each of two outer ends of a rear side of the seat plate 3 has a C shape tenon 31 which can be assembled to the T shape buckle 12 at the inner side of the front leg 1. Each of two ends of an inner side of the seat plate 3 has a sliding groove 32 for assembling the post 22 of the rear leg 2.

Assembly of the present invention will be described herein.

The T shape buckles 22 are aligned to the recesses 11 of the front legs. Then the studs 21 are assembled into the recesses 11. Then the covers 14 cover upon the holes. The cover 14 has a plug 141 and the plug 141 has a hook 142. When the plug 141 of the cover 14 inserts into the hole 111 of the recess 11. The cover 14 is firmly secured to the front leg without loosing. Thus the assembly of the front legs to the rear legs 2 is completed.

Then the post 22 of the front leg slides into the sliding groove 32 of the seat plate 3. Finally, the C shape tenon 31 of the seat plate 3 is buckled to the T shape buckle 12 of the front leg 1. Thus the assembly of the whole chair is complete.

Therefore, the chair of the present invention can be assembled without screws, but it still has a firm structure and the assembly work can be performed quickly and easily with less time and high efficiency. Moreover, the chairs can be overlapped vertically with less space so as to be transferred effectively and with lower transfer costs.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A foldable adapted to be overlapped with other chairs of identical structure, comprising two front legs, two rear legs and a seat plate, wherein two front legs (1); an inner side of each front leg having a recess (11) for assembling a respective, rear leg (2) and a T-shaped buckle (12); and a hole (111) being formed in the recess for retaining a cover (14); the cover having a plug (141) and the plug (141) having a hook (142);

a transversal rod (13) connecting the two front legs; the transversal rod having a trench (131);

each of two sides of a top end of an outer side of each rear leg (2) having a post (22) for assembling a seat plate (3); a transversal bar (23) being assembled between two inner sides of the two rear legs; each of two ends of the transversal bar (23) having a strip (231) adapted to be embedded into the trench (131) of the transversal rod (13);

each of two outer ends of a rear side of the seat plate (3) having a C-shaped tenon (31) which is adapted to be assembled to the T-shaped buckle at the inner side of the front leg; each of two ends of an inner side of the seat plate having a sliding groove (32) for receiving the post (22) of the rear leg;

wherein when assembled, the T-shaped buckles (12) are aligned with the recesses (11) of the front legs; studs (21) are received into the recesses of the front legs (11); the covers (14) covering the holes (111) the plug (141) of the cover is inserted into the hole (111) of the recess of the front legs; the cover is firmly secured to the front leg free of any play; the post (22) of the front leg slidable in the sliding groove (32) of he seat plate; and the C-shaped tenon (31) of the seat plate (3) buckled to the T-shaped buckle (12) of the front leg.

2. The foldable chair of clam 1, wherein the chair is made of a polypropylene plastics and fiber mixture and is formed by air injection.

* * * * *